US006923589B2

(12) United States Patent
Blackwell

(10) Patent No.: US 6,923,589 B2
(45) Date of Patent: Aug. 2, 2005

(54) LIPSTICK CASE AND REFILL CARTRIDGE

(76) Inventor: Jamion Uriah Blackwell, 14329 Chandler Blvd. #26, Sherman Oaks, CA (US) 91401

( * ) Notice: Subject to any disclaimer, the term of this patent is extended or adjusted under 35 U.S.C. 154(b) by 39 days.

(21) Appl. No.: 10/678,793

(22) Filed: Oct. 3, 2003

(65) Prior Publication Data

US 2004/0134819 A1 Jul. 15, 2004

Related U.S. Application Data

(60) Provisional application No. 60/415,567, filed on Oct. 3, 2002.

(51) Int. Cl.[7] ..... B43K 23/02
(52) U.S. Cl. ..... 401/131; 401/98; 206/385
(58) Field of Search ..... 401/131, 195, 401/68, 78, 80, 87, 98; 206/385, 581, 823, 38.1

(56) References Cited

U.S. PATENT DOCUMENTS 544,533 A * 8/1895 Harpfer ..... 401/69
544,609 A * 8/1895 Boman ..... 401/55
5,067,836 A * 11/1991 Khan ..... 401/52
5,573,109 A * 11/1996 Isacson ..... 206/38.1
5,617,751 A * 4/1997 Song ..... 206/38.1
5,876,137 A * 3/1999 Byrd ..... 401/78
6,102,598 A * 8/2000 Hsu ..... 401/60
6,526,991 B2 * 3/2003 Bodwalk ..... 401/190
6,782,999 B1 * 8/2004 McCoy et al. ..... 206/223

FOREIGN PATENT DOCUMENTS

EP 0571922 A1 * 12/1993

* cited by examiner

*Primary Examiner*—Khoa D. Huynh

(57) ABSTRACT

An apparatus for distributing and safely housing lipstick, the apparatus comprises a lipstick casing and an assembled refilling cartridge. The lipstick casing has a top cap, an O-ring connected to the attachment of the top cap, a hollow body including a retainer lip formed inside the body, and an end cap. The assemble refilled cartridge has a plastic cup, a s-cut sheath, a spiral cut sheath, and a cartridge end cap. The lipstick casing provides the slip free grip and housing protection for the assembled refilled cartridge and allow the user to use the fully assembled refill cartridge without removing the refill cartridge from the lipstick casing.

1 Claim, 5 Drawing Sheets

LIPSTICK CASE AND REFILL CARTRIDGE

This application claims the benefit of application Ser. No. 60/415,567 filed Oct. 3, 2002.

FIELD OF THE INVENTION

The present invention relates to lipstick cases and, more particularly, to lipstick cases that have a refillable cartridge, refill via breech loading, are extremely durable and rigid and are attached to keyrings via a swivel o-ring.

BACKGROUND OF THE INVENTION

For decades cosmetics have been an essential part of most women's daily beauty regimine. The problem however lies in cheaply made cases that crush, allow lipstick to melt, feel cheap, look cheap, don't protect the lipsticks sufficiently, open unexpectedly in a woman's purse, and may actually get lost in the bottom of a woman's handbag. Because lipstick cases are relatively inexpensive plastic, tin, or low grade aluminum, most consumers have little choice on a quality brand of lipstick that not only feels good, but looks good as well.

Cosmetics are traditionally a throw away product. There are many different shapes, sizes, etc. The materials used to construct the cases are typically plastic, tin, and aluminum. Some companies have come up with innovative items such as a ring on the top of the cap so the consumer can wear it on a rope or their keys.

These other cases still don't address the other problems, such as cheaply made plastick components, opening in a purse, or getting lost in a handbag. They are often cheaply made work-arounds that don't really get the job done. A woman with more refined tastes, that can afford the best is still usually stuck with cheaply made cosmetic components simply because there is nothing better available. Also, because of the cheap materials used to make other lipstick componentry, screw down caps are usually impractical or impossible due to the extreme forces acting on the material itself, causing stress fractures in the components or breakage. This leads to leaks, and non functional components.

It is therefore an object of the invention to house and protect cosmetic products.

It is another object of the invention to prevent such product from being damaged or damaging other property.

It is another object of the invention to use high end materials on a product that is typically not done.

It is another object of the invention to allow the user to attach product to their keyrings, etc.

SUMMARY OF THE INVENTION

In accordance with the present invention, there is provided a lipstick case and it's refill compontent that allows for the protection and housing of cosmetic products. The lipstick case comprises an o-ring that is used to attach lipstick case to a keyring, purse, etc. This case and it's respective refill cartridge are comprised of a total of 7 sub-components but maybe comprised from as little as six to as many as 10.

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the FIGURES.

DESCRIPTION OF THE PREFERRED EMBODIMENT

Figure 1:
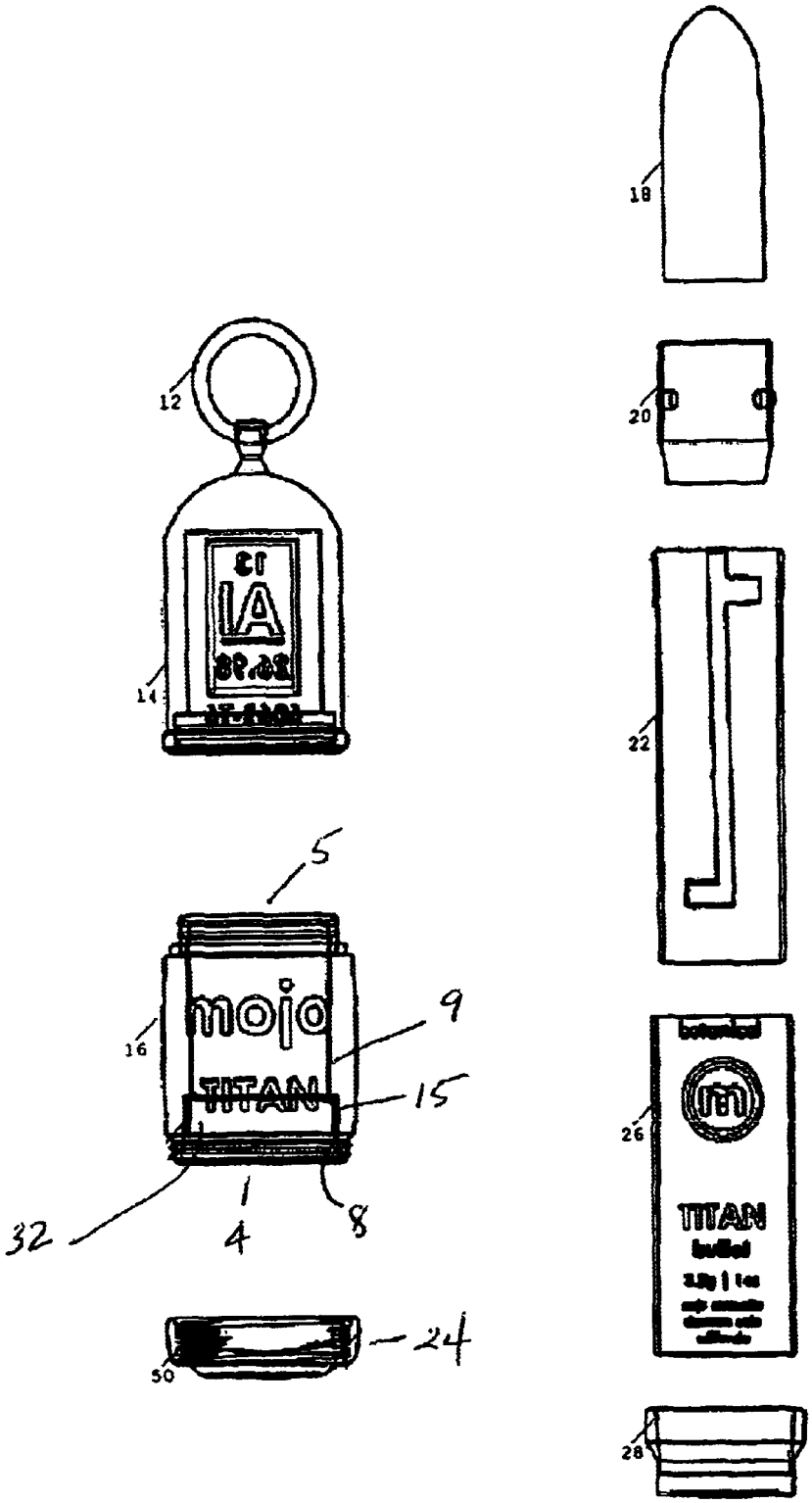
FIG. 1 is a front view of a Lipstick case and refill component expanded view of all items that comprise lipstick and refill cartridge.

FIG. 1 is an expanded front view of a fully assembled lipstick case and cartridge 44 (shown fully assembled in FIG. 4) in accordance with this invention. An o-ring 12, shown in FIG. 1 is attached to a removable or non removable o-ring 12 divot or attachment 42 shown in FIG. 4. This attachment is then secured to the top cap 14. This o-ring 12 can be fashioned out of any suitable material by any means and is rigid but is also able so swivel on a limited axis. It can be any shape, round, oval, square or angular and serves to secure the lipstick case to a key ring, purse strap, etc. It has a space in the bottom with two tapered ends 56. This feature prevents the o-ring 12 from cutting material away from the o-ring 12 divot or attachment 42.

Figure 4:
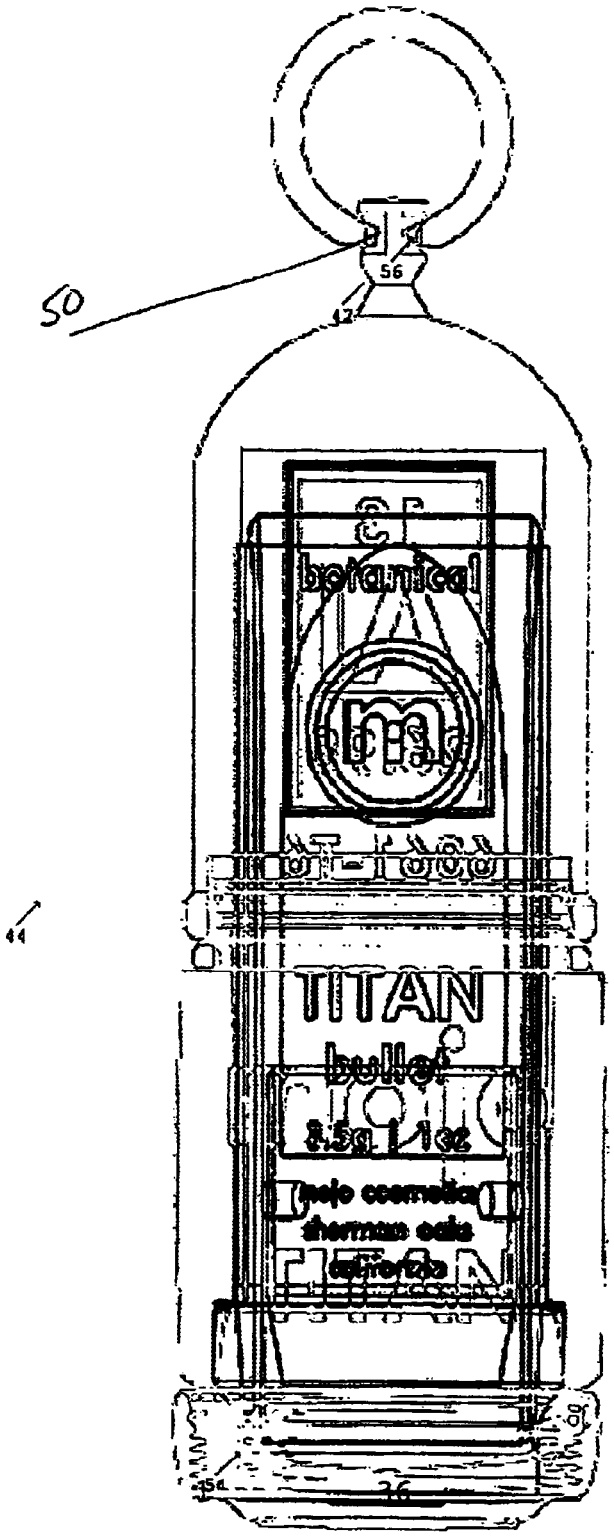
FIG. 4 is a front view of a fully assembled lipstick and cartridge.

The o-ring 12 divot or attachment 42 can be removable or non removable and rigid, durable, and can be fabricated by any means, from any suitable material. It can have a hole drilled all the way through so a rope, chain, or any other instrument can be strung through. This particular iteration of the design has a small indention 50 drilled on each side with a retainer wall in the middle. The wall serves to stop an o-ring 12 from spinning, there by exposing a seam. The tapered ends 56 shown in FIG. 4 are securely clamped into these two indentations.

The top cap 14 shown in FIG. 1 is where the divot or attachment 42 secures into or is on top of. This top cap 14 is the first of 3 main pieces that comprise a fully assembled lipstick case 46. This cap is rigid, durable, and can be fabricated by any means, from any suitable material and serves to not only to protect and cover a fully assembled refill cartridge 48 inside, but also to have a means by which to secure the o-ring 12 which then secures to the o-ring 12 divot or attachment 42, which then secures to the top cap 14. This top cap 14 is secured by topcap threading 34, a pressure fit, or a friction fit. This top cap 14 is then fitted and or screwed onto a body 16.

Figure 3:
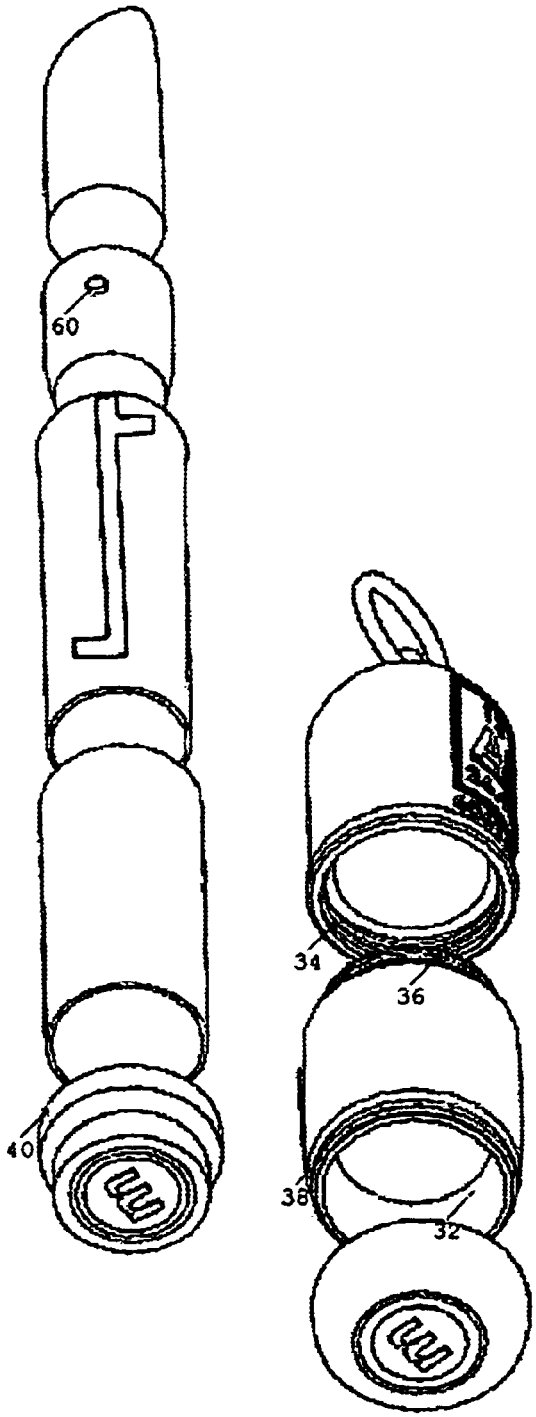
FIG. 3 is a perspective view of an expanded ¾ view of lipstick case and cartridge.

The body 16 shown in FIG. 1 is the second piece that comprises the fully assembled lipstick case 46. It is rigid, durable, and can be fabricated by any means, from any suitable material. The body has an front opening 5 and a back opening 4, this body 16 has 3 main features on it. The first feature a threading_upper 36 shown in FIG. 3, the second feature, threading_lower 38 also shown in FIG. 3, and a third feature, a retainer lip 32 also shown in FIG. 3. The threading upper 36 is the place where the top cap 14 docks onto the body 16. The threading_lower 38 is where an end cap 24 docks onto the body 16. These threadings can be changed to a pressure fit, or a friction fit as needed. The retainer lip 32 that stops a cartridge endcap 28 from sliding further up the inside of the body 16. This retainer lip 32 includes a larger inner diameter 8 at said back opening, a step portion 15 and an inner smaller diameter 9 extending from said step portion toward the front opening. Whereby the hollow body by which the fully assembled cartridge slides through, becomes increasingly smaller at the top, thereby trapping a cartridge endcap 28 partially inside the retainer lip. This body 16 serves to house the fully assembled refill cartridge 48, while allowing a spiral cut sheath 26 to rotate freely on a vertical axis inside of it.

The end cap 24 shown in FIG. 1 is the 3rd piece of the fully assembled lipstick case 46. It is rigid, durable, and can be fabricated by any means, from any suitable material. This end cap 24 is a critical piece of engineering to the fully assembled lipstick case 46. It has one main feature, the endcap threading 50, shown in FIG. 1. This end cap 24 docks onto the threading_lower 38 body 16 and is screwed on or can also be fabricated to have a friction fit or a pressure fit. As the end cap 24 is twisted up the threading-lower body 16, it puts increasing more pressure against a cartridge endcap 28, this in conjunction with the body 16 counterbore 32 serves to lock the cartridge endcap 28 into a locked position while still allowing the components from the fully assembled refill cartridge 48-such as the standard 0.477 plastic cup 20, s-cut sheath 22, and spiral cut sheath 26 to move rotationally or on a vertical axis.

A lipstick slug 18 shown in FIG. 1 is the overall end product that this fully assembled lipstick case and cartridge 44 is made to house, protect, and distribute. However, since it is not claimed, no more will be written on this.

A standard 0.477 plastic cup 20 shown in FIG. 1 is a critical part used in this invention, and holds the lipstick product 18 in place. But since it comes in many different forms, and is available to any manufacturer that wants to buy it, it is not claimed in the document.

Figure 5:
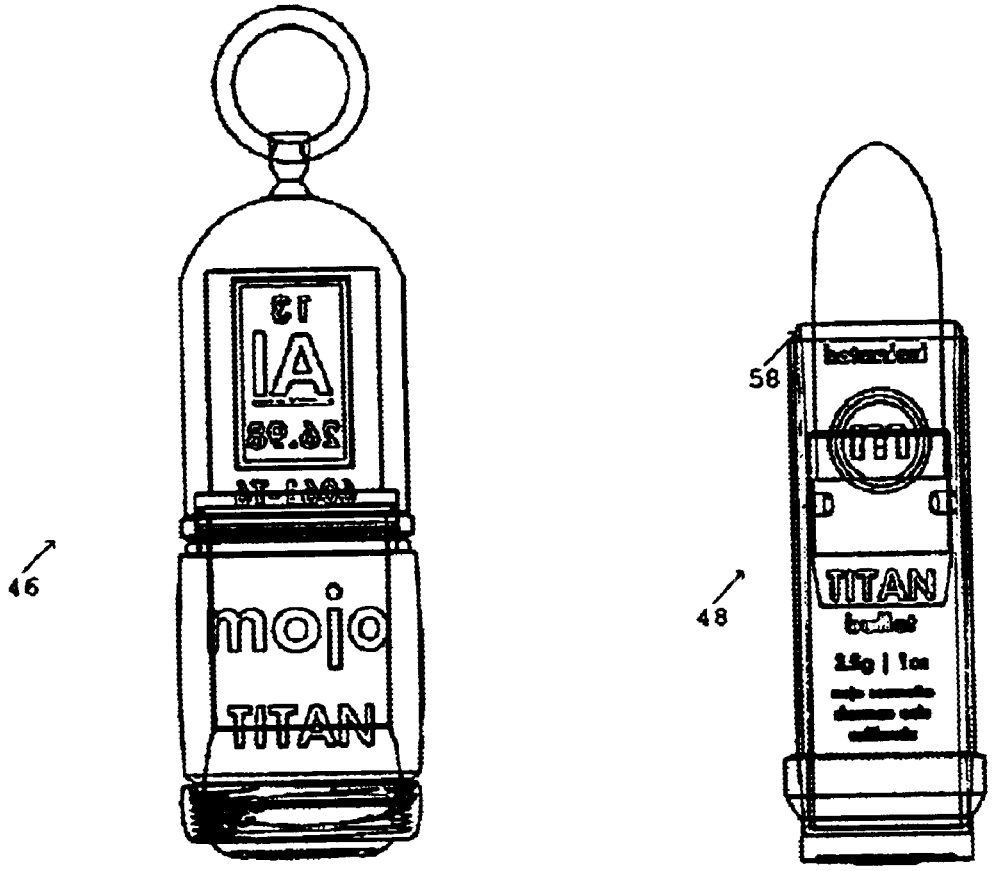
FIG. 5 is a front view of a fully assembled lipstick case and cartridge.

The s-cut sheath 22 shown in FIG. 1, is a critical part for the operation of the fully assembled refill cartridge 48 shown in FIG. 5. It is rigid, durable, and can be fabricated by any means, from any suitable material. This s-cut sheath 22 gets it's name due to the s-cut down both sides parallel to each other. The s-cuts provides a means by which the 0.477 cup divots 60 shown in FIG. 3, slide up and down on a locked axis. This lip 40 then slides through the spiral cut sheath 26 and then clamps into the cartridge end cap 28, shown in FIG. 1. What makes this particular s-cut sheath 22 special is the s-cut sheath retainer lip 58, shown in FIG. 5. This lip 58 serves to block the spiral cut sheath 26 from advancing further up the outside of the s-cut sheathe 22 and unlike other lipsticks, it is actually above and outside the spiral cut sheath 26 as opposed to inside of it along a groove near the top. This allows stronger, non-flexing materials to be used in the construction of the lipstick case.

The spiral cut sheath 26, shown in FIG. 1, is another critical piece of the fully assembled refill cartridge 48. It is rigid, durable, and can be fabricated by any means, from any suitable material. This spiral cut sheath 26 is a hollow tube that slide over the s-cut sheath 22 and stops at the top of the s-cut sheath by the s-cut sheath retainer lip 58. It can be rotated in a clockwise or counterclockwise fashion. Spiral vertical grooves are cut inside the sheath roughly the same diameter as the 0.477 cup divots 60. As this spiral cut sheath 26 is spun, it pushes the 0.447 cup divots up the grooves but due to the s-cut sheath 22, these 0.477 cup divots 60 can only push the standard 0.477 plastic cup 20 up and down on a vertical axis. The spiral cut sheath 26 is held from advancing further on its vertical axis by the s-cut sheath 22 retainer lip 58 and the cartridge endcap 28 lip 40 to fit against the retainer lip 32 of the hollow body 16. What makes this spiral cut sheath 26 special is that it's held in place the reverse of all other products on the market. Other lipstick containers work on this principle: The spiral cut sheath is bent over, at the top, the s-cut sheath 22 to prevent the s-cut sheath 22 from advancing upward. My invention works by using the s-cut sheath 22 and the s-cut sheath retainer lip 58 to stop the spiral cut sheath 26 from advancing further.

The cartridge endcap 28, shown in FIG. 1, is the final piece in the fully assembled refill cartridge 48. It is rigid, durable, and can be fabricated by any means, from any suitable material. This cartridge endcap 28 can and does use a pressure fit and a friction fit. It can also be held in place by any suitable means. The s-cut sheath 22 snaps into the cartridge endcap 28 and restricts horizontal, rotational, and vertical movement to the s-cut sheath 22. The spiral cut sheath is then allowed to spin around the stationary s-cut sheath 22. This cartridge endcap 28 has a lip 40 on it that locks against the counterbore 32 in the back of the body 16, which prevents if from moving further forward. The endcap is then screwed up the threading_bottom, pushing the cartridge endcap 28 into a snug and secure fit against the counterbore 32.

Figure 2:
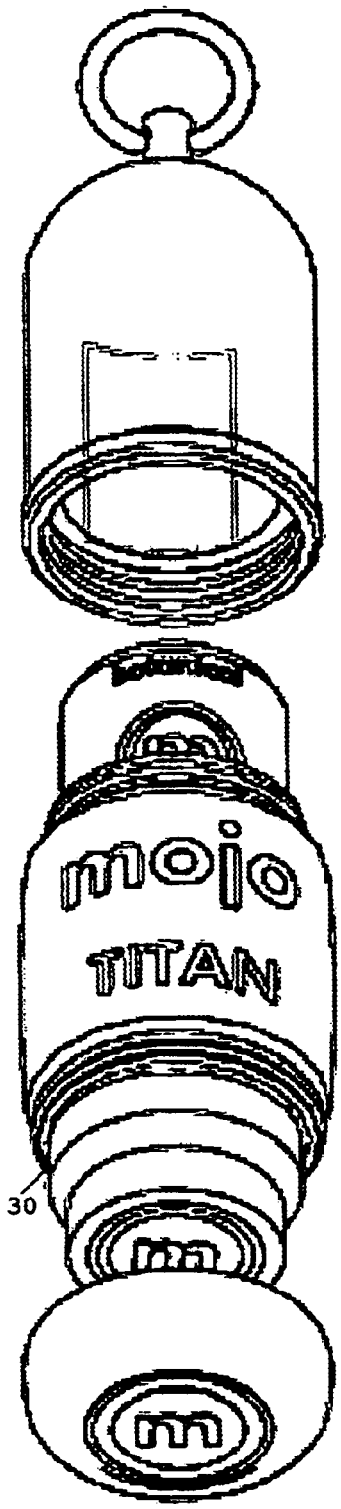
FIG. 2 is a perspective view of a view showing assembled cartridge being inserted into body of lipstick case.

FIG. 2, which is a perspective view of cartridge insertion 30 of a fully assembled refill cartridge 48 into a fully assembled lipstick case 46, with the top cap 14 and the end cap 24 removed. The top cap 14 does not have to be removed to perform cartridge insertion 30, however, the end cap 24 does have to be removed, and the screwed back on once the fully assembled refill cartridge 48 is in place.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. An apparatus for distributing and safely housing lipstick, said apparatus comprising:

a lipstick casing, said lipstick casing further comprising:

a top cap having at top portion and a lower portion, said top cap having an attachment attached to said top portion of said top cap and a top cap threading located at said lower portion of said top cap, an O-ring having tapered ends connected to said attachment, said attachment having a small drilled indentation on each side with a retainer wall in the middle, wherein said tapered ends of said O-ring securely clamped into said indentations and said retainer wall serves to stop said O-ring from spinning, a hollow body having a front opening and a back opening, said front opening having a threading upper for connecting to said top cap threading, said back opening having a threading lower, said body also having a retainer lip formed inside said back opening of said body, said retainer lip having a larger inner diameter at said back opening, a step portion and an inner smaller diameter extending from said step portion toward the front opening, and an end cap having end cap threading for connecting said end cap to said threading lower of said top cap;

an assembled refilling cartridge further comprising:

a plastic cup that holds a lipstick product, said cup having cup divots, a s-cut sheath having s-cuts down both sides parallel to each other, said s-cuts allow the cup divots to slide up and down on a lock axis, said s-cut sheath also having a s-cut sheath lip located at the top of said s-cut sheath, a spiral cut sheath slides over said s-cut sheath and stops at the top of said s-cut sheath by said s-cut sheath lip, and a cartridge end cap having a lip that is friction fit into said retainer lip of said body, wherein said plastic cup, said s-cut sheath, said spiral cut sheath and said cartridge end cap are assembled into the fully assembled refill cartridge;

wherein when the fully assembled refill cartridge is inserted into said back opening of said body of the lipstick casing, said lip of said cartridge end cap is snug fit against said retainer lip of said body and thus, prevent the assembled refill cartridge and said cartridge end cap from sliding further upward, wherein upon attaching the end cap to the back opening of the body, said end cap further pushes the cartridge end cap against said retainer lip of said body and locks the cartridge end cap in place, and thereby allowing the user to raise the lipstick product up and down by spinning said spiral cut sheath which protrudes outwardly from said front opening of said body, wherein said body and said end cap provide the slip free grip and housing protection for said full assembled refilled cartridge and allow the user to use the fully assembled refill cartridge without removing the refill cartridge from the lipstick casing.

* * * * *